US006840038B2

(12) United States Patent
Katayama et al.

(10) Patent No.: US 6,840,038 B2
(45) Date of Patent: Jan. 11, 2005

(54) EXHAUST SYSTEM FOR OUTBOARD MOTOR

(75) Inventors: Goichi Katayama, Shizuoka (JP); Katsumi Ochiai, Shizuoka (JP); Masanori Takahashi, Shizuoka (JP)

(73) Assignee: Yamaha Marine Kabushiki Kaisha, Shizuoke (JP)

( * ) Notice: Subject to any disclaimer, the term of this patent is extended or adjusted under 35 U.S.C. 154(b) by 0 days.

(21) Appl. No.: 10/228,435

(22) Filed: Aug. 27, 2002

(65) Prior Publication Data

US 2003/0056502 A1 Mar. 27, 2003

(30) Foreign Application Priority Data

Aug. 27, 2001 (JP) ..... 2001-257031

(51) Int. Cl.[7] ..... F02B 27/02

(52) U.S. Cl. ..... 60/312; 60/313; 60/323; 440/89 R

(58) Field of Search ..... 60/274, 312, 313, 60/323, 324; 440/88 R, 88 J, 89 R, 89 C, 89 D, 88, 89

(56) References Cited

U.S. PATENT DOCUMENTS 4,951,465 A 8/1990 Torigai
5,674,099 A 10/1997 Muramatsu et al.
5,806,311 A 9/1998 Okamoto
5,893,783 A * 4/1999 Hiraoka et al. ..... 60/323
6,039,012 A * 3/2000 Motoyama ..... 60/324
6,071,159 A 6/2000 Watanabe et al.
6,302,754 B1 10/2001 Kashima
6,338,660 B1 * 1/2002 Fukuda ..... 440/89
6,425,790 B2 * 7/2002 Nakata et al. ..... 440/89
6,454,622 B2 9/2002 Mashiko et al.
6,511,356 B2 * 1/2003 Yukishima ..... 60/323

OTHER PUBLICATIONS

U.S. Appl. No. 09/860,989 filed May 17, 2001, entitled "Exhaust System for Outboard Motor," and amended on Jul. 11, 2002.

Publication No. US 2002/0068491 A1, published on Jun. 6, 2002, entitled "Exhaust System for Outboard Motor".

* cited by examiner

*Primary Examiner*—Tu M. Nguyen
(74) *Attorney, Agent, or Firm*—Knobbe, Martens, Olson & Bear, LLP

(57) ABSTRACT

An exhaust system for an internal combustion engine of an outboard motor is provided. The exhaust system provides dual exhaust passages, simplifying the engine's construction and reducing manufacturing costs, while optimizing engine performance. The exhaust system includes exhaust ports having equal lengths that avoid differential pressure losses across cylinders. The arrangement of the exhaust passages enables a cowling to have a tapered aerodynamic design.

18 Claims, 9 Drawing Sheets

EXHAUST SYSTEM FOR OUTBOARD MOTOR

RELATED APPLICATION

This application claims priority to Japanese Patent Application No. 2001-257031, filed on Aug. 27, 2001, the entire contents of which are hereby expressly incorporated by reference.

BACKGROUND OF THE INVENTION

1. Field of the Invention

The present invention relates to outboard motors for watercraft, and in particular, to an exhaust system for an outboard motor.

2. Description of the Related Art

Outboard motors containing internal combustion engines are commonly used for powering watercraft. A housing, which is mounted to a transom of the watercraft, typically encloses the engine. Rotation of a crankshaft of the internal combustion engine drives a driveshaft. The driveshaft drives a water propulsion device, such as a propeller. When the watercraft operates, the propeller is submerged beneath a water surface. Rotation of the propeller moves the watercraft across the water surface.

Many internal combustion engines in outboard motors include four cylinders and operate on the four-stroke combustion cycle. The four-stroke combustion cycle is well known to those of skill in the art, and therefore will not be explained in detail here. Four-stroke engines comprise a crankcase in which the crankshaft is housed, a cylinder block extending generally horizontally from the crankcase, and a cylinder head extending generally horizontally from the cylinder block. The cylinder block defines four cylinder bores that are generally arranged vertically. The cylinder head defines four exhaust ports, with one exhaust port being associated with each cylinder. Each exhaust port expels exhaust gases into a runner, which provides a fluid communication path between its associated cylinder and an exhaust passage. The exhaust passage discharges the exhaust gases to the atmosphere.

Some four-cylinder four-stroke engines include first and second exhaust passages extending generally vertically through the cylinder block. An engine having a dual exhaust passage configuration is simpler and less expensive to construct than an engine with four exhaust passages. The exhaust ports of two of the cylinders communicate with the first exhaust passage, and the exhaust ports of the other two cylinders communicate with the second exhaust passage.

In order to reduce interference of the exhaust gas flow from the cylinders, the cylinders are paired according to the firing order. For example, the cylinders are paired such that the timing of the opening of the exhaust valves of the two cylinders communicating with the first exhaust passage are not sequential. Similarly, the timing of the opening of the exhaust valves of the two cylinders communicating with the second exhaust passage are not sequential. For example, if the first and fourth cylinders communicate with the first exhaust passage, and the second and third cylinders communicate with the second exhaust passage, then a preferred firing order would be 1-2-4-3.

Non-sequential exhaust timing eliminates interference between exhaust gases traveling through the same exhaust passage. If the exhaust times of the two exhaust ports communicating with the same exhaust passage were sequential, then the exhaust gas pulse from one cylinder could interfere with the next exhaust pulse from the other cylinder. Providing a temporal gap between exhaust pulses entering the same exhaust passage reduces the interaction between exhaust pulses discharged from the cylinders. Thus, non-sequential exhaust timing allows each cylinder to exhaust under equal pressure, leading to better engine performance.

In engines having non-sequential exhaust timing, the exhaust passages are arranged side by side in a lateral (port to starboard) direction. This arrangement increases an overall width of the engine. A sturdy plastic cowling typically encloses the engine. As the width of the engine increases, so must the width of the cowling. Ideally, however, the width of the cowling decreases gradually toward the top. This design provides the cowling with a more pleasing appearance and with more favorable aerodynamic properties. A wider engine compromises these two desirable properties of the cowling. Some outboard motors provide a tapered cowling even for very wide, non-tapering engines by creating a large lateral gap between the engine and the cowling at a lower end of the engine. However, this solution only expands the overall width of the cowling and wastes material for the cowling.

Because the exhaust passages are arranged side by side in a lateral direction, one of the exhaust passages is spaced farther from the cylinders. Therefore, the exhaust runners leading to the farther exhaust passage are longer than the exhaust runners leading to the nearer exhaust passage. The cylinder head defines exhaust runners. A cylinder head having exhaust runners of unequal lengths is more complex, and therefore more expensive to manufacture, than a cylinder head having exhaust runners of equal lengths.

Furthermore, the cylinders all have equal volumes. Therefore, gases passing through exhaust runners of different lengths experience different pressure losses. As explained above, cylinders exhausting under unequal pressure compromise engine performance. Prior attempts at eliminating the problems caused by laterally side-by-side exhaust passages and exhaust runners of unequal lengths have been unsuccessful.

SUMMARY OF THE INVENTION

The preferred embodiments of the present exhaust system for outboard motor have several features, no single one of which is solely responsible for their desirable attributes. Without limiting the scope of this exhaust system for outboard motor as expressed by the claims that follow, its more prominent features are discussed below. After considering this discussion, and particularly after reading the section entitled "Detailed Description of the Preferred Embodiments," one will understand how the features of the preferred embodiments provide advantages, which include optimized engine performance with a simplified design that is inexpensive to manufacture, and the ability to receive a cowling that is attractive and aerodynamic.

One aspect of the present invention includes the realization that an arrangement of dual exhaust passages can be altered such that the exhaust ports defined in the cylinder head can have the same length, while allowing the exhaust passages to remain in a side-by-side arrangement. As such, engine performance can be enhanced and the complexity of certain engine components can be reduced.

In accordance with one preferred embodiment of the present invention, a four-cycle, four-cylinder internal combustion engine for an outboard motor comprises a crankcase, a crankshaft rotatably supported by the crankcase about a vertically extending axis. The engine includes a first cylinder, a second cylinder, a third cylinder and a fourth cylinder, with their axes being substantially parallel and intersecting the axis of rotation. A cylinder block extends from the crankcase and defines the cylinders. A cylinder head is secured to the cylinder block opposite the crankcase. The cylinder head defines at least four exhaust ports, each exhaust port being in selective fluid communication with one of the cylinders. The exhaust ports provide fluid communication paths from combustion chambers in the cylinders to exhaust passages. The cylinder block has first and second exhaust passages formed therein, the exhaust passages extending generally vertically. The exhaust ports of the first and second cylinders each have a downstream end connected to the first exhaust passage at first inlets, and the exhaust ports of the third and fourth cylinders each have a downstream end connected to the second exhaust passage at second inlets. The engine is configured such that first and second cylinders do not perform exhaust strokes consecutively and such that the third and fourth cylinders do not perform exhaust strokes consecutively. The first and second inlets are located equidistant from the cylinders as measured in a direction perpendicular to both the axis of rotation and the cylinder axes.

In accordance with another aspect of the invention, an internal combustion engine comprises an engine body, the engine body defining at least first and second cylinder bores. A crankshaft is journaled for rotation at least partially within the engine body. The engine is configured such that the crankshaft is generally vertical and the cylinder bores are generally horizontal during operation. The engine body defines at least first and second combustion chambers therein. First and second exhaust ports extend from the first and second combustion chambers, respectively. A first exhaust passage extends downwardly from a first outlet of the first exhaust port. A second exhaust passage extends from a second outlet of the second exhaust port, generally parallel to the cylinder bores and around the outlet of the first exhaust port, then downwardly and generally parallel to the first exhaust passage.

In accordance with yet another aspect of the presnet invention, an exhaust system for an outboard motor includes a four-cylinder internal combustion engine. The exhaust system comprises a first exhaust passage extending generally vertically along a cylinder block and having an outlet end in a surrounding medium. A second exhaust passage extends along the cylinder block and has an outlet end in the surrounding medium. First exhaust ports provide first fluid communication paths from a first combustion chamber and a second combustion chamber to the first exhaust passage. Second exhaust ports provide second fluid communication paths from a third combustion chamber and a fourth combustion chamber to the first exhaust passage. The first and second exhaust ports are all equal in length.

In accordance with another aspect of the present inevntion, a method of improving the performance of a four-cylinder internal combustion engine comprises the steps of providing a first exhaust passage, providing a second exhaust passage, providing a first fluid path from a first cylinder to the first exhaust passage, providing a second fluid path from a second cylinder to the first exhaust passage, providing a third fluid path from a third cylinder to the second exhaust passage, and providing a fourth fluid path from a fourth cylinder to the second exhaust passage. All the fluid paths are of equal length. Additionally, the method includes providing an exhaust sequence in which exhaust times of the first and second cylinders are not consecutive, and in which exhaust times of the third and fourth cylinders are not consecutive.

BRIEF DESCRIPTION OF THE DRAWINGS

The preferred embodiments of the exhaust system for outboard motor, illustrating its features, will now be discussed in detail. These embodiments depict the novel and non-obvious exhaust system for outboard motor shown in the accompanying drawings, which are for illustrative purposes only. These drawings include the following figures, in which like numerals indicate like parts.

DETAILED DESCRIPTION OF THE PREFERRED EMBODIMENTS

Figure 1:
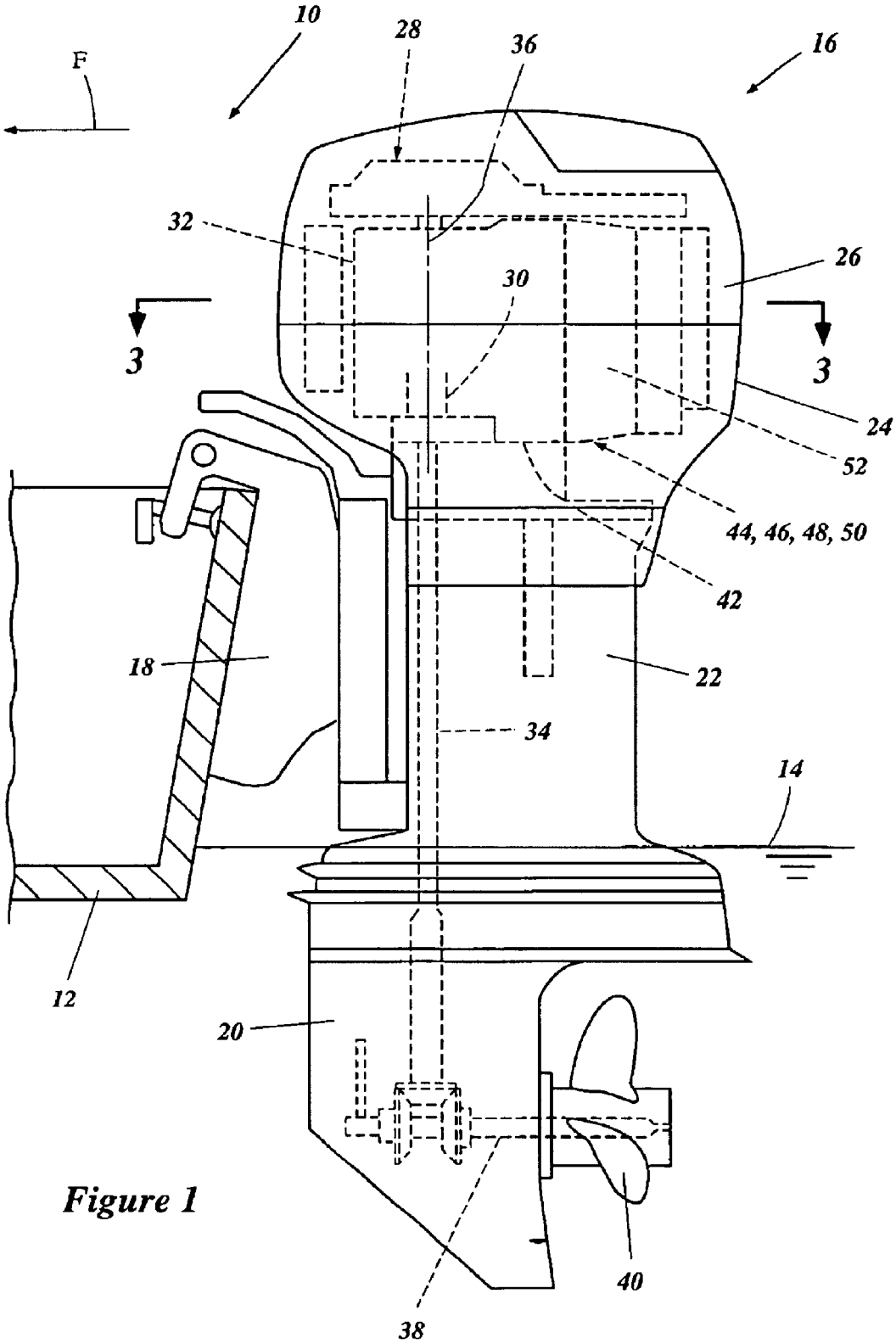
FIG. 1 is a side elevational view of an outboard motor constructed in accordance with the present exhaust system for outboard motor, with certain features including an engine, driveshaft, and transmission shown in phantom.

With reference to FIG. 1, the description below provides an overall configuration of an outboard motor. This description assists the reader's understanding of a preferred environment of use for the present exhaust system for outboard motor. However, as those of skill in the art will appreciate, the present exhaust system and associated components described below can be used in other vehicles, such as, for example, but without limitation, personal watercraft, jet boats, off-road vehicles, and other vehicles. Additionally, the outboard motor is described with reference to a coordinate system wherein a longitudinal axis extends from fore to aft and a lateral axis extends from port side to starboard side normal to the longitudinal axis. In addition, relative heights are expressed as elevations in reference to the under surface of the watercraft. In various figures, an arrow labeled "F" points along the longitudinal axis and indicates a forward direction of travel for the watercraft.

FIG. 1 illustrates a watercraft 10 comprising a hull 12 floating on a water surface 14. The watercraft 10 includes an outboard motor 16. A clamping bracket 18 secures the outboard motor 16 to the hull 12.

A casing houses the components of the outboard motor 16. The casing includes a lower portion 20, which is submerged beneath the water surface 14, an intermediate portion 22 of "driveshaft housing" extending generally vertically from the lower portion 20, and an upper portion 24 extending generally vertically from the intermediate portion 22.

The upper portion 24 comprises a cowling 26, which is generally constructed of a sturdy plastic. The cowling 26 contains an internal combustion engine 28, which generates power to propel the watercraft 10 across the water surface 14. In the illustrated embodiment, the engine 28 includes four cylinders and operates on the four-stroke combustion cycle, however, engines operating under different principles (rotary, diesel, two-stroke, etc.) and having other sumbers of cylinders can be used.

The engine 28 turns a crankshaft 30, which is housed in a crankcase 32. The crankshaft 30 turns a vertically extending driveshaft 34. The driveshaft 34, having an axis of rotation 36, extends from the upper portion 24, through the intermediate portion 22 and into the lower portion 20. A lower end of the driveshaft 34 is operably connected to a propeller shaft 38, which rotates with the driveshaft 34. The propeller shaft 38 extends generally parallel to the water surface 14, and includes a propeller 40 mounted to an aft end thereof. The propeller 40 rotates with the propeller shaft 38, generating force on the water. The reaction force of the water upon the propeller 40 propels the watercraft 10 across the water surface 14.

Figure 2:
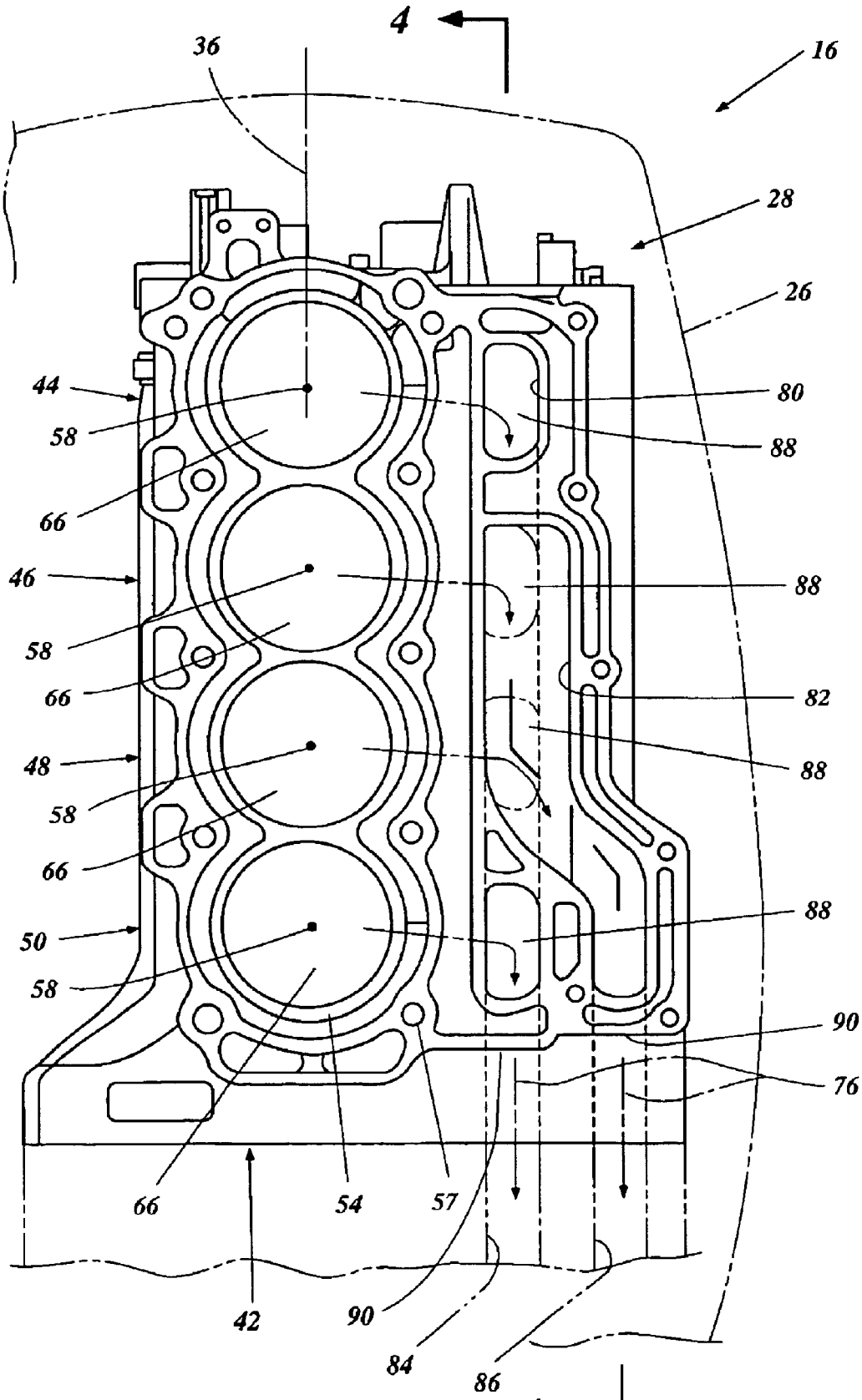
FIG. 2 is a cross-sectional rear view of the outboard motor of FIG. 1, taken along line 2—2 in FIG. 3 and illustrating the cylinder block and exhaust passages.

The engine 28 comprises a cylinder block 42 defining the cylinders 44, 46, 48, 50 (FIG. 2). The cylinder block 42 is preferably constructed of die-cast aluminum. However, as those of skill in the art will appreciate, the cylinder block 42 may be constructed of a variety of other materials, such as iron.

A cylinder head 52 extends from an aft facing substantially vertical face 54 (FIG. 3) of the cylinder block 42. The cylinder head 52 comprises a substantially vertical face 56 (FIGS. 3 and 4) that is preferably secured to the cylinder block face 54 with fasteners 57 (FIG. 2). A sealing gasket (not shown) is preferably disposed between the abutting faces 54, 56. Like the cylinder block 42, the cylinder head 52 is preferably constructed of die-cast aluminum. However, as those of skill in the art will appreciate, the cylinder head 52 may be constructed of a variety of other materials, such as iron.

The cylinders 44, 46, 48, 50 are preferably arranged vertically, and are preferably equally spaced from one another in the vertical direction. For ease of reference, the cylinders 44, 46, 48, 50 are numbered first through fourth (FIG. 2). The uppermost cylinder will be referred to herein as the first cylinder 44, the next uppermost cylinder will be referred to as the second cylinder 46, the next uppermost cylinder will be referred to as the third cylinder 48, and the lowermost cylinder will be referred to as the fourth cylinder 50. A longitudinal axis 58 (FIG. 2) of each cylinder 44, 46, 48, 50 extends in the direction of the longitudinal axis of the watercraft 10. Each cylinder 44, 46, 48, 50 houses a piston 60 (FIG. 3), which is slidable within the cylinder 44, 46, 48, 50 along the cylinder axis 58.

Figure 3:
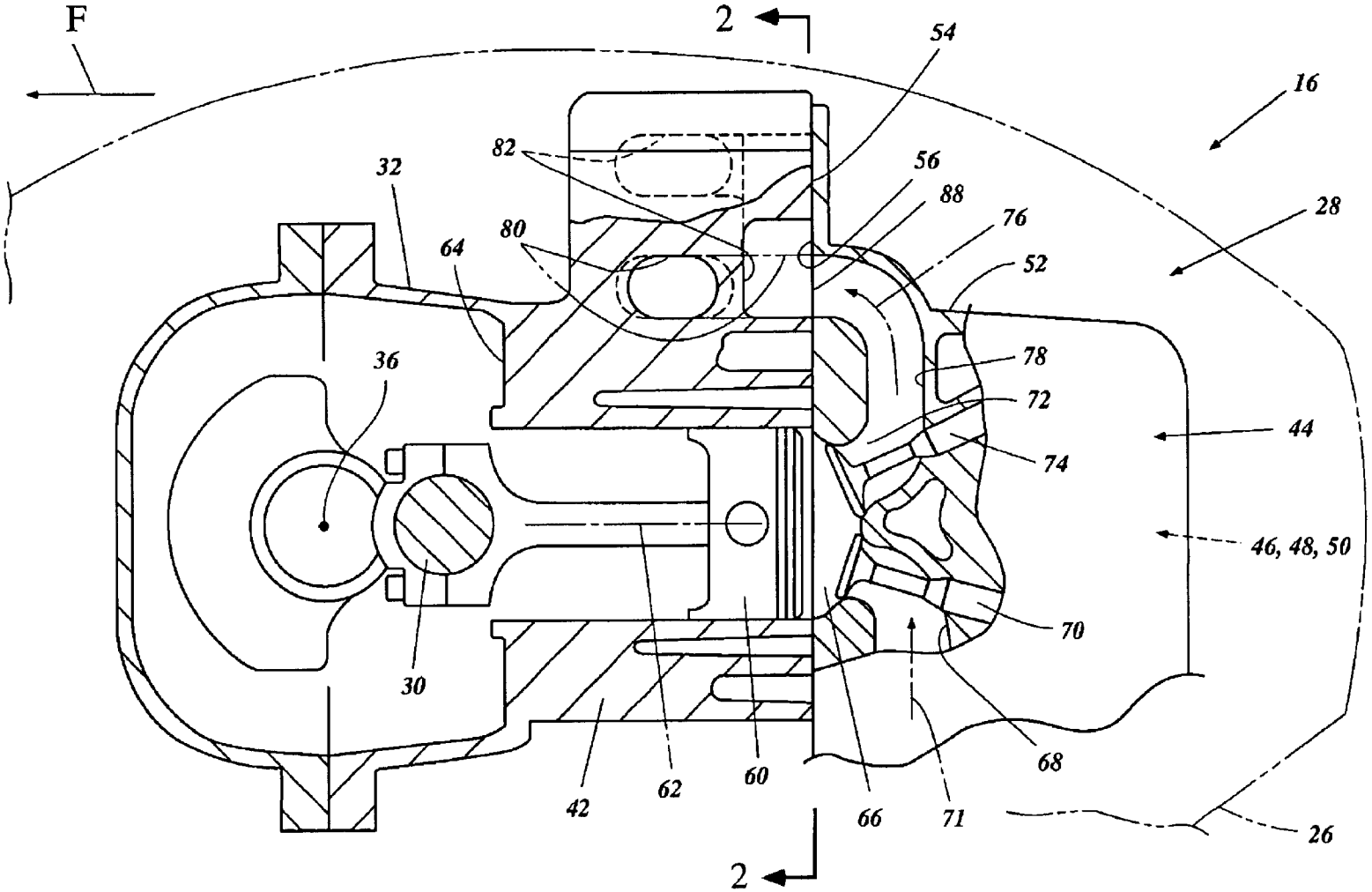
FIG. 3 is a partial cross-sectional top view of the outboard motor of FIG. 1, taken along a horizontal plane passing through the first cylinder and extending generally fore to aft and illustrating the cylinder block, cylinder head and exhaust passages.

The pistons 60 reciprocate within their respective cylinders 44, 46, 48, 50 in response to combustion reactions in each cylinder 44, 46, 48, 50. A piston rod 62 (FIG. 3) connects each piston 60 to the crankshaft 30, which is housed in the crankcase 32. The crankcase 32 extends in the direction of the arrow F from a substantially vertical face 64 of the cylinder block 42 (FIG. 3). The reciprocating motion of the pistons 60 turns the crankshaft 30, which turns the vertically extending driveshaft 34.

A space defined between the cylinder head 52 and the piston 60 in each cylinder comprises a combustion chamber 66 (FIGS. 2 and 3). Each combustion chamber 66 includes an associated intake port 68 (FIG. 3), which is formed in the cylinder head 52. An intake valve 70 selectively opens and closes each intake port 68, enabling air-fuel charges 71 to enter the combustion chamber 66 during the intake stroke.

Each combustion chamber 66 also includes an associated exhaust valve seat 72 (FIG. 3), which is also formed in the cylinder head 52. An exhaust valve 74 selectively opens and closes each vavle seat 72, enabling the exhaust gases 76 to exit the combustion chamber 66 during the exhaust stroke. The opening and closing of the intake and exhaust valves 70, 74 is synchronized with rotation of the crankshaft 30.

An exhaust port 78 extends from each of the valve seats 72. FIG. 3 illustrates only one exhaust valve 74 and valve seat 72 per cylinder. However, any number of exhaust valves 74 and seats 72 can be included for each combustion chamber 66.

Figure 4:
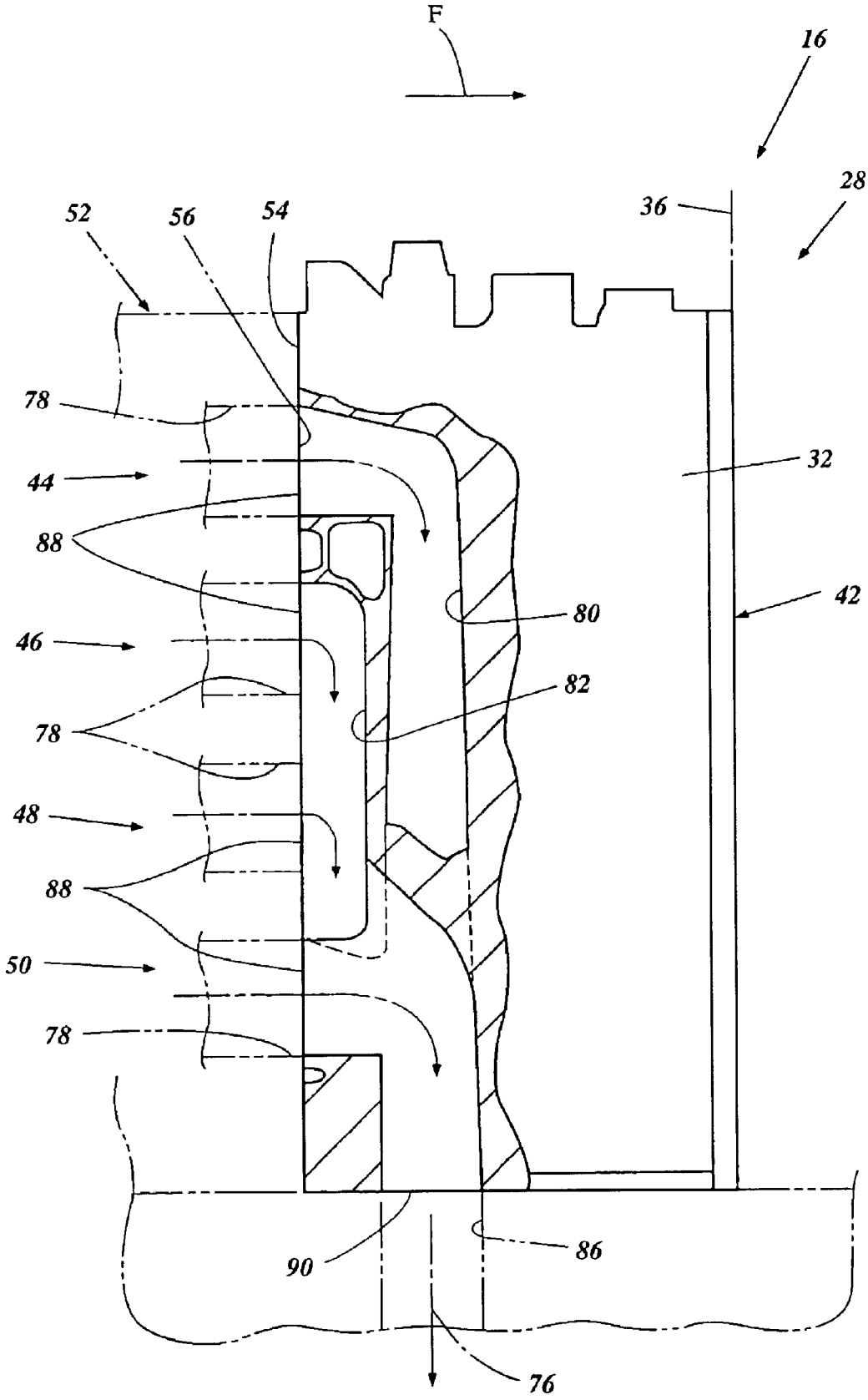
FIG. 4 is a partial cross-sectional view of the outboard motor of FIG. 1, taken along line 4—4 in FIG. 2 and illustrating the exhaust passages.

In the illustrated embodiment, the exhaust port 78 is a curved, substantially U-shaped, tubular passage (FIG. 3) extending from the valve seat 72 to an exhaust passage 80, 82 (FIGS. 3 and 4). Each exhaust port 78 is preferably the same size, such that a gas path through each exhaust runner 78 is the same length.

A downstream end of each exhaust port 78 opens into one of the exhaust passages 80, 82 (FIGS. 3 and 4). The exhaust passages 80, 82 each comprise a tubular portion of the cylinder block 42 that is spaced from the cylinders 44, 46, 48, 50 in the lateral direction and positioned rearwardly of the axis of rotation 36.

The exhaust passages 80, 82 extend generally vertically through the cylinder block 42. A lower end of the first exhaust passage 80 opens into a first lower exhaust passage 84, and a lower end of the second exhaust passage 82 opens into a second lower exhaust passage 86 (FIG. 2). The lower exhaust passages 84, 86 extend into the intermediate portions 20 of the casing (FIG. 1). Preferably, the exhaust passages 84, 86 terminate in an expansion chamber (not shown) before being expelled to the atmosphere. Preferably, the outboard motor 16 includes an above the water exhaust discharge (not shown) for idle speed operation and a below the water exhaust discharge (not shown) for higher speed operation.

The strokes of the pistons 60 are performed in sequence. A phase difference between sequential pistons 60 is preferably 90°, as measured in terms of an angle of the crankshaft 30. However, the phase difference would be different in engines having other numbers of cylinders and other cylnder configurations (e.g., opposed, V, and W configurations).

A preferred firing order for the cylinders 44, 46, 48, 50 is the first cylinder 44, followed by the third cylinder 48, followed by the fourth cylinder 50, followed by the second cylinder 46. Thus, the exhaust strokes of the first cylinder 44 and the fourth cylinder 50, which both communicate with the first exhaust passage 80, are not consecutive, i.e., another cylinder (the third cylinder 48) performs the exhaust stroke between the exhaust strokes of cylinders 44 and 50.

Similarly, the exhaust strokes of the second cylinder 46 and the third cylinder 48, which both communicate with the second exhaust passage 82, are not consecutive.

Non-consecutive exhaust timing avoids the negative engine performance consequences described above. Those of skill in the art will appreciate that non-consecutive exhaust timing is not crucial to proper functioning of the present exhaust system. Those of skill in the art will further appreciate that the cylinders 44, 46, 48, 50 could have a different firing order, whether the order achieved non-consecutive exhaust timing or not.

The downstream ends of the exhaust ports 78 of the first and fourth cylinders 44, 50 open into the first exhaust passage 80 at inlets 88 (FIGS. 2–4). The downstream ends of the exhaust ports 78 of the second and third cylinders 46, 48 open into the second exhaust passage 82 at inlets 88.

As shown in FIG. 2, all four exhaust inlets 88 are located equidistant from their associated cylinder 44, 46, 48, 50 in the lateral direction. Thus, all the exhaust runners 78 have the same length, and each provides the same pressure loss to the exhaust gases 76 as the gases 76 pass through the ports 78. Thus, each cylinder exhausts gases 76 at more uniform pressure, with more uniform fluid flow characteristics, reducing differences across cylinders that impede optimum engine performance.

The present exhaust system facilitates optimum engine performance even with the relatively simple dual exhaust passage configuration. The equal-length exhaust ports 78 further simplify the cylinder head 52. If the cylinder head 52 is die-cast, the cores used to form the exhaust vale seats 72 can be equal sized, which simplifies the process of making the die. The simplified engine manufacturing process advantageously lowers the cost of manufacturing the engine 28.

An upper end of the first exhaust passage 80 is located relatively close to the cylinders 44, 46, 48, 50, as measured in the lateral direction (FIG. 2). The first exhaust passage 80 extends straight down through the cylinder block 42 in a direction parallel to the axis of rotation 36 (FIG. 2).

The upper portion of the second exhaust passage 82 is located the same distance from the cylinders 44, 46, 48, 50 as the first exhaust passage 80, as measured in the lateral direction and at substantially the same height as a midportion of the first exhaust passage 80 (FIG. 2). The upper portion of the second exhaust passage 82 extends straight down through the cylinder block 42 in a direction parallel to the first exhaust passage 80.

At approximately the height of a lower portion of the third cylinder 48 (FIGS. 2 and 4), a lower portion of the second exhaust passage 82 preferably extends away from the cylinders 44, 46, 48, 50 in the lateral direction (FIG. 2). The lower portion subsequently curves toward the first exhaust passage 80 in the longitudinal direction (FIG. 4), and then downward (FIGS. 2 and 4) in a direction parallel to the axis of rotation 36. An outlet 90 of the second exhaust passage 82 (FIGS. 2 and 4), which is located approximately at the height of the fourth cylinder 50, extends in a direction parallel to an outlet 90 of the first exhaust passage 80, and is spaced therefrom in the lateral direction (FIG. 2).

The illustrated arrangement of the exhaust passages 80, 82 prevents the exhaust passages 80, 82 from interfering with each other. The upper extent of the second exhaust passage 82 is located below the inlet 88 associated with the first cylinder 44 (FIG. 2), and the lower portion of the second exhaust passage 82 is routed around the inlet 88 associated with the fourth cylinder 50 (FIG. 2). This arrangement creates greater freedom to arrange the lower portions of the exhaust passages 80, 82, and facilitates easy connection of the outlets 90 to the first and second lower exhaust passages 84, 86 (FIG. 2).

With reference to FIG. 2, because the upper portions of the first and second exhaust passages 80, 82 are located in close proximity to the cylinders 44, 46, 48, 50 as measured in the lateral direction, the width of the upper portion of the engine 28 is less than the width of the lower portion of the engine 28. Thus, a width of the cowling 26 that covers the engine 28 can have an inwardly tapered shape, which creates the aesthetic and aerodynamic benefits described above without wasting cowling 26 material.

In the illustrated embodiment, the first and second exhaust passages 80, 82 are entirely independent from one another. Thus, the exhaust gases 76 from the first and fourth cylinders 44, 50 do not interfere with the exhaust gases 76 from the second and third cylinders 46, 48. This arrangement eliminates the undesirable effects on engine performance of exhaust back pressure, which are described above.

Those of skill in the art will appreciate that the relationship of the cylinders 44, 46, 48, 50 to the exhaust passages 80, 82 could be altered. For example, the first cylinder 44 and second cylinder 46 could be connected to the first exhaust passage 80, and the third cylinder 48 and fourth cylinder 50 could be connected to the second exhaust passage 82. In this arrangement, the second exhaust passage 82 would extend only as high as the third cylinder 48. Also in this arrangement, a preferred firing order for the cylinders 44, 46, 48, 50 would be the first cylinder 44, followed by the third cylinder 48, followed by the second cylinder 46, followed by the fourth cylinder 50.

FIGS. 5–9 illustrate further preferred embodiments of the present exhaust system for outboard motor. In these figures reference numbers that are identical to reference numbers in FIGS. 1–4 indicate features that are substantially identical to the same features in the embodiment of FIGS. 1–4. Such features will not be described again below. Rather, the description below focuses on the differences between the further embodiments and the embodiment of FIGS. 1–4. Those of skill in the art will appreciate that the features of the further embodiments may be combined with the features of the embodiment of FIGS. 1–4.

Figure 5:
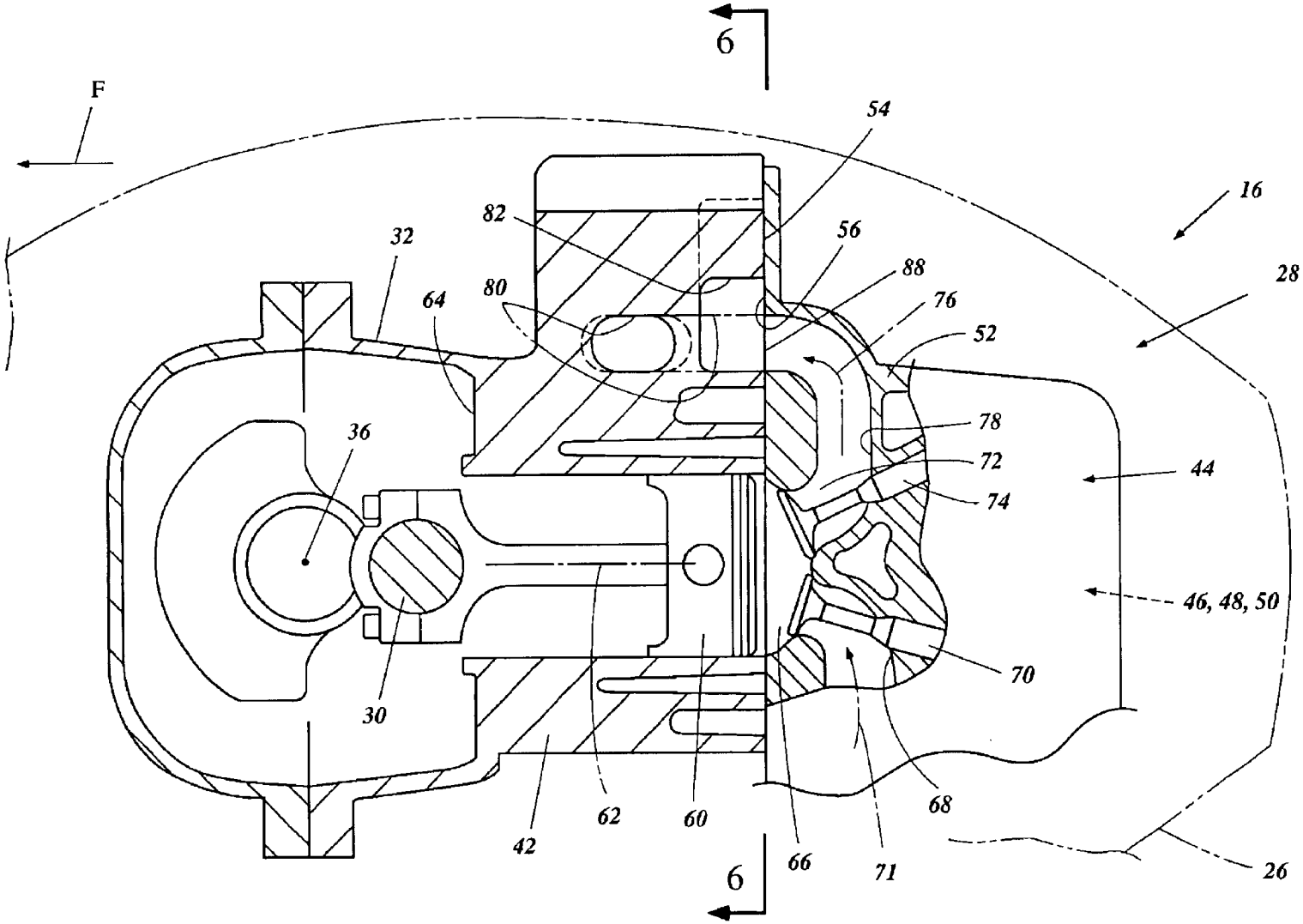
FIG. 5 is a partial cross-sectional top view of a modification of the outboard motor of FIG. 1, taken along a horizontal plane passing through the first cylinder and extending generally fore to aft and illustrating the cylinder block, cylinder head and exhaust passages.
Figure 6:
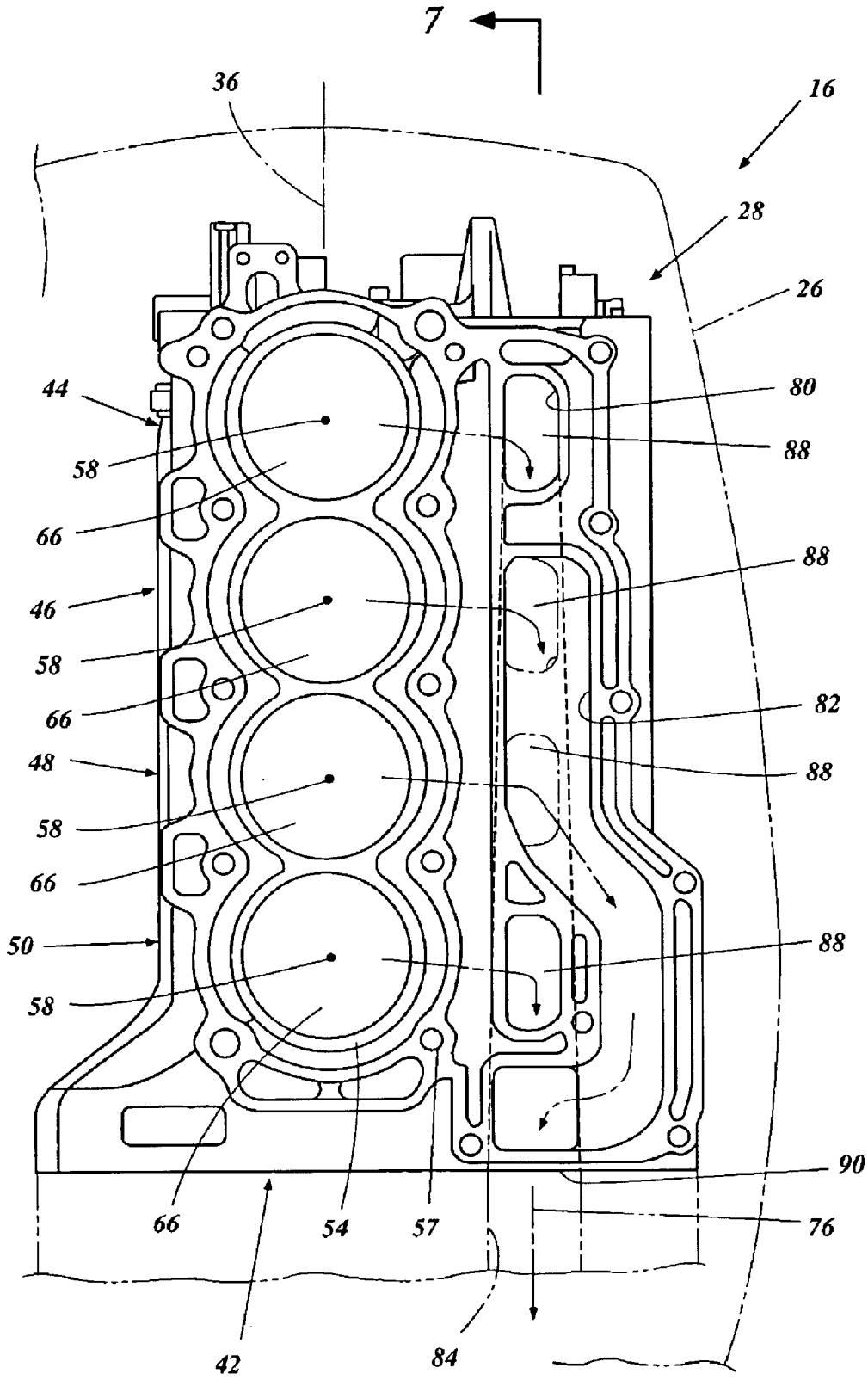
FIG. 6 is a cross-sectional rear view of the outboard motor of FIG. 5, taken along line 6—6 in FIG. 5 and illustrating the cylinder block and exhaust passages.
Figure 7:
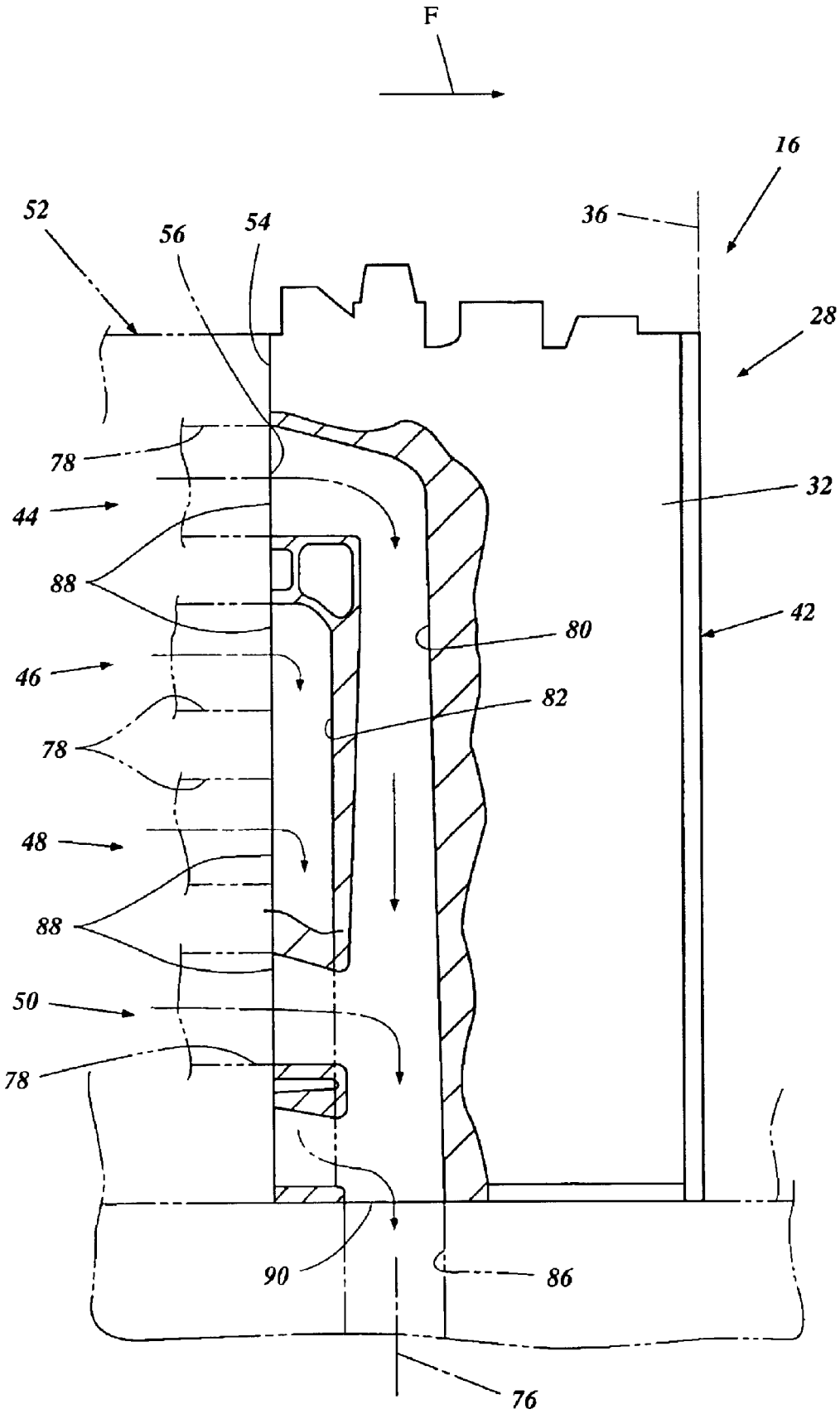
FIG. 7 is a partial cross-sectional side view of the outboard motor of FIG. 5, taken along line 7—7 in FIG. 6 and illustrating the exhaust passages.

In the embodiment of FIGS. 5–7, the second exhaust passage 82 extends back toward the cylinders 44, 46, 48, 50 in the lateral direction (FIG. 6) at a position below the inlet 88 of the fouth cylinder 50. The outlet 90 of the second exhaust passage 82 connects to the first exhaust passage 80. The combined outlets 90 of the first and second exhaust passages 80, 82 open into a lower exhaust passage 84, which extends into the intermediate portion 22.

This embodiment requires only one lower exhaust passage to transfer exhaust gases 76 from the first and second exhaust passages 80, 82 to intermediate portion 22. Thus, this embodiment is well adapted for simplified exhaust arrangements including only one lower exhaust passage.

Figure 8:
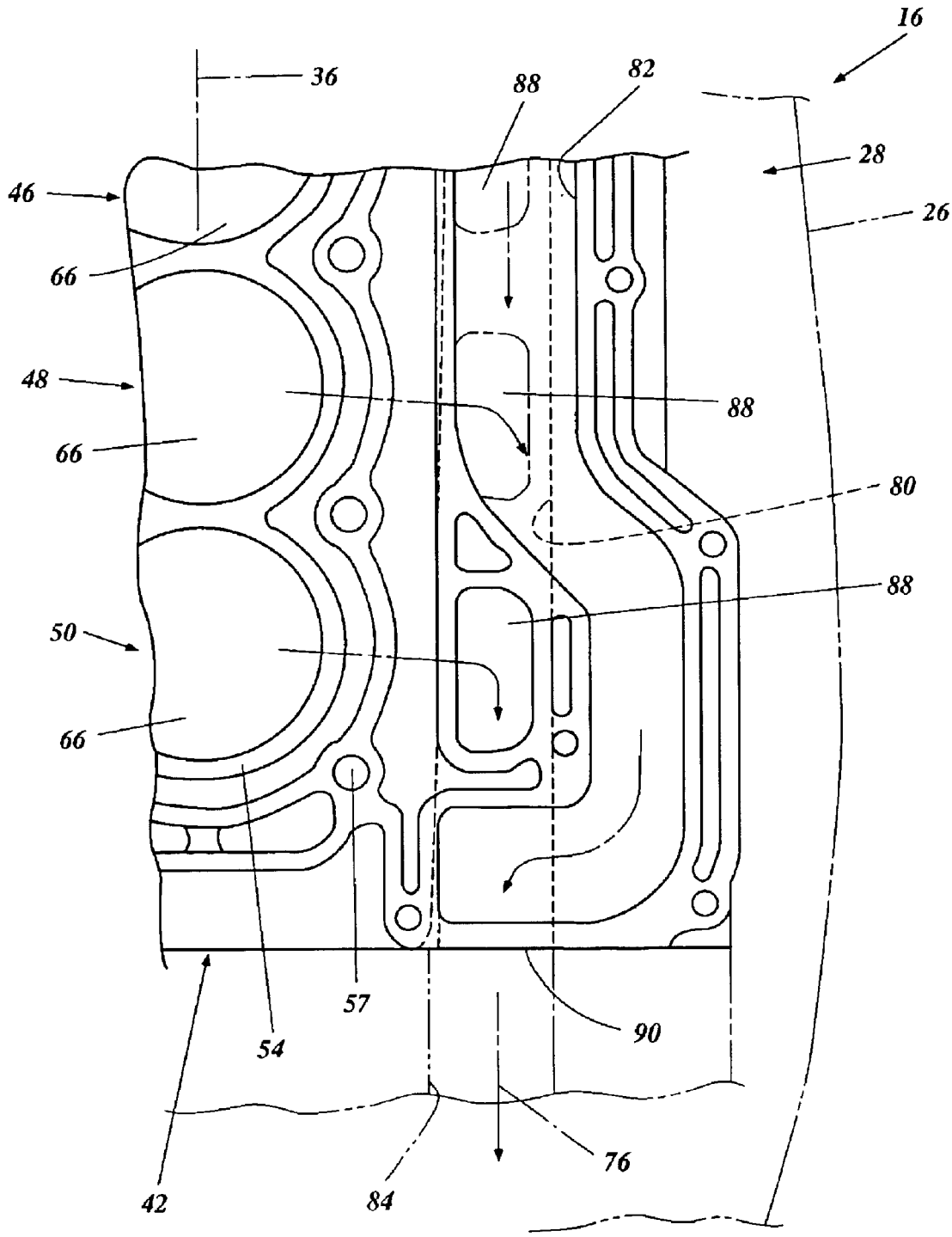
FIG. 8 is an enlarged cross-sectional rear view of a modification of the outboard motor of FIG. 1, taken along a vertical plane passing through the junction between the cylinder block and cylinder head and illustrating lower portions of the cylinder block and exhaust passages.
Figure 9:
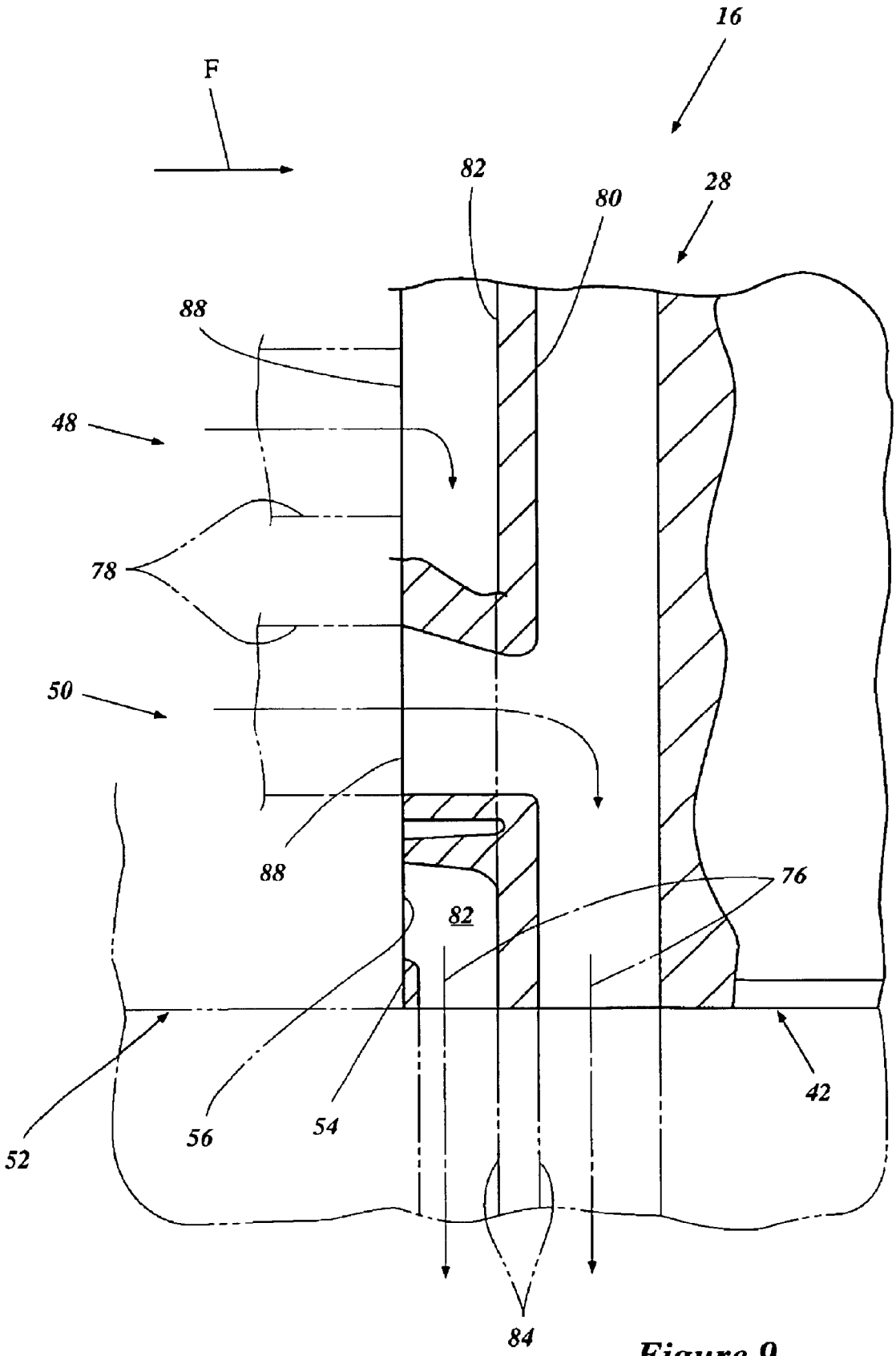
FIG. 9 is an enlarged cross-sectional side view of the outboard motor of FIG. 8, taken along line 9—9 in FIG. 8 and illustrating lower portions of the exhaust passages.

In the embodiment of FIGS. 8 and 9, the outlet 90 of the second exhaust passage 82 extends back toward the cylinders 44, 46, 48, 50 in the lateral direction (FIG. 8) at a position below the inlet 88 of the cylinder 50. The passage 82 extends forward into the cylinder block 42 and then extends straight downward in the direction of the axis of rotation 36, and does not connect with outlet 90 of the first exhaust passage 80. This arrangement reduces a lateral width of the engine 28 at the height of the outlets 90. Thus, the cowling 26 at this height can be made more narrow. This arrangement is advantageous for outboard motors requiring more narrow cowlings.

Scope of the Invention

The above presents a description of the best mode contemplated for carrying out the present exhaust system for outboard motor, and of the manner and process of making and using it, in such full, clear, concise, and exact terms as to enable any person skilled in the art to which it pertains to make and use this exhaust system for outboard motor. This exhaust system for outboard motor is, however, susceptible to modifications and alternate constructions from that discussed above that are fully equivalent. Consequently, this exhaust system for outboard motor is not limited to the particular embodiments disclosed. On the contrary, this exhaust system for outboard motor covers all modifications and alternate constructions coming within the spirit and scope of the exhaust system for outboard motor as generally expressed by the following claims, which particularly point out and distinctly claim the subject matter of the exhaust system for outboard motor.

What is claimed is:

1. An exhaust system for an outboard motor, the outboard motor including a four-cylinder internal combustion engine, the system comprising a first exhaust passage extending generally vertically along a cylinder block and having an outlet end in a surrounding medium, a second exhaust passage extending along the cylinder block and having an outlet end in the surrounding medium, first exhaust ports providing first fluid communication paths from a first combustion chamber and a second combustion chamber to the first exhaust passage, and second exhaust ports providing second fluid communication paths from a third combustion chamber and a fourth combustion chamber to the second exhaust passage, wherein the first and second exhaust ports are all equal in length and lower portions of the first and second exhaust passages intersect.

2. An internal combustion engine comprising an engine body, the engine body defining at least first and second cylinder bores, a crankshaft journaled for rotation at least partially within the engine body, the engine being configured such that the crankshaft is generally vertical and the cylinder bores are generally horizontal during operation, the engine body defining at least first and second combustion chambers therein, first and second exhaust ports extending from the first and second combustion chambers, respectively, a first exhaust passage extending downwardly from a first outlet of the first exhaust port, a second exhaust passage extending from a second outlet of the second exhaust port, generally parallel to the cylinder bores and around the outlet of the first exhaust port, then downwardly and generally parallel to the first exhaust passage, wherein the first exhaust passage includes, at a lower portion thereof, a first bend away from the cylinders, and the first exhaust passage further includes a second bend downstream from the first bend, the second bend being toward the cylinders.

3. The engine of claim 2, wherein the first exhaust passage further includes a third bend downstream from the second bend, the third bend being toward the cylinders.

4. The engine of claim 3, wherein the first exhaust passage is connected, downstream of the third bend, to the second exhaust passage.

5. The engine of claim 3, wherein the first exhaust passage is entirely independent of the second exhaust passage and a lower end of the first exhaust passage is substantially parallel to a lower end of the second exhaust passage and spaced therefrom in the direction of the cylinder axes.

6. An internal combustion engine comprising an engine body, the engine body defining at least first and second cylinder bores, a crankshaft journaled for rotation at least partially within the engine body, the engine being configured such that the crankshaft is generally vertical and the cylinder bores are generally horizontal during operation, the engine body defining at least first and second combustion chambers therein, first and second exhaust ports extending from the first and second combustion chambers, respectively, a first exhaust passage extending downwardly from a first outlet of the first exhaust port, a second exhaust passage extending from a second outlet of the second exhaust port, generally parallel to the cylinder bores and around the outlet of the first exhaust port, then downwardly and generally parallel to the first exhaust passage, wherein the first and second outlets lie in the same plane, and are located along a first axis that is parallel to a second axis that intersects the longitudinal axis of each of the cylinders.

7. The engine of claim 6, wherein upper portions of the first and second exhaust passages are located adjacent the cylinders and are equidistant from the cylinders as measured in the lateral direction.

8. The engine of claim 6, in combination with an outboard motor and further comprising a cowling for covering the engine, the cowling being shaped such that a width thereof gradually decreases toward a top thereof, as viewed in the direction of the cylinder axes.

9. The engine of claim 6, wherein the first and second outlets are located in the same plane.

10. The engine of claim 6, wherein exhaust ports are all of equal length.

11. The engine of claim 6, additionally comprising third and fourth cylinders, wherein the first cylinder is disposed below the second cylinder, the third cylinder being below the first cylinder, and the fourth cylinder being below the third cylinder, wherein the second and fourth cylinders are connected to the exhaust passage and the first and third cylinders are connected to the first exhaust passage.

12. The engine of claim 11, wherein a firing order for the cylinders is the second cylinder, followed by the cylinder, followed by the fourth cylinder, followed by the cylinder.

13. The engine of claim 6, wherein the first exhaust passage includes, at a lower portion thereof, a first bend away from the cylinders.

14. The engine of claim 13, wherein the first exhaust passage further includes a second bend downstream from the first bend, the second bend being toward the crankcase in the direction of the cylinder axes.

15. The engine of claim 14, wherein the first exhaust passage further includes a third bend downstream from the second bend, the third bend being downward.

16. The engine of claim 15, wherein a portion of the first exhaust passage downstream from the third bend is substantially parallel to the second exhaust passage and spaced therefrom in the direction perpendicular to both an axis of rotation of the crankshaft and the cylinder axes.

17. The engine of claim 16, wherein the first and second exhaust passages are entirely independent of each other.

18. A four-cycle, four-cylinder internal combustion engine for an outboard motor, comprising a crankcase, a crankshaft rotatably supported by the crankcase about an axis of rotation thereof, the axis extending vertically, a first cylinder, a second cylinder, a third cylinder and a fourth cylinder, axes of the cylinders being substantially parallel and intersecting the axis of rotation, a cylinder block extending from the crankcase and defining the cylinders, and a cylinder head secured to the cylinder block opposite the crankcase, the cylinder head defining at least four exhaust ports, each exhaust port being in selective fluid communication with one of the cylinders, the exhaust ports providing fluid communication paths from combustion chambers in the cylinders to exhaust passages, wherein the cylinder block has first and second exhaust passages formed therein, the exhaust passages extending generally vertically, the exhaust ports of the first and second cylinders each have a downstream end connected to the first exhaust passage at first inlets, the exhaust ports of the third and fourth cylinders each have a downstream end connected to the second exhaust passage at second inlets, the engine being configured such that the first and second cylinders do not perform exhaust strokes consecutively and such that the third and fourth cylinders do not perform exhaust strokes consecutively, and the first and second inlets are located equidistant from the cylinders as measured in a direction perpendicular to both the axis of rotation and the cylinder axes.

* * * * *

UNITED STATES PATENT AND TRADEMARK OFFICE

CERTIFICATE OF CORRECTION

PATENT NO. : 6,840,038 B2
APPLICATION NO. : 10/228435
DATED : January 11, 2005
INVENTOR(S) : Goichi Katayama et al.

It is certified that error appears in the above-identified patent and that said Letters Patent is hereby corrected as shown below:

At column 3, line 42, please delete “presnet” and insert -- present, -- therefor.

At column 3, line 57, please delete “inevntion,” and insert -- invention, --, therefor.

At column 5, line 19, please delete “sumbers” and insert -- numbers --, therefor.

At column 6, line 58, please delete “cylinder” and insert -- cylinder --, therefor.

At column 8, line 46, please delete “fouth” and insert -- fourth --, therefor.

At column 10, line 34, in Claim 11, after “to the” please insert -- second --.

At column 10, line 37, in Claim 12, after “by the” please insert -- first --.

At column 10, line 38, in Claim 12, after “cylinder, followed by the” please insert -- third --.

Signed and Sealed this

Twentieth Day of May, 2008

JON W. DUDAS
*Director of the United States Patent and Trademark Office*